United States Patent [19]

Golovko

[11] 3,971,640

[45] July 27, 1976

[54] METHOD OF SEPARATING KRYPTON-XENON CONCENTRATE FROM AIR

[76] Inventor: Georgy Anatolievich Golovko, Pushkin 8, bulvar A. Tolstogo, 16, kv. 29, Leningrad, U.S.S.R.

[22] Filed: Mar. 18, 1975

[21] Appl. No.: 559,410

[30] Foreign Application Priority Data

Apr. 26, 1974 U.S.S.R. ..... 2015806

[52] U.S. Cl. ..... 55/66; 55/75

[51] Int. Cl.[2] ..... B01D 53/04

[58] Field of Search ..... 55/28, 66, 75

[56] References Cited

UNITED STATES PATENTS

| | | | |
|---|---|---|---|
| 2,793,507 | 5/1957 | Hnilicka | 55/66 X |
| 3,890,121 | 6/1975 | Thomas | 55/66 X |

*Primary Examiner*—John Adee

*Attorney, Agent, or Firm*—Steinberg and Blake

[57] ABSTRACT

The method of separating krypton-xenon concentrate from air, containing 1–46 per cent by volume of krypton, 0.1 – 4 per cent by volume of xenon, 94.9 – 46 per cent by volume of nitrogen, not more than 2 per cent by volume of oxygen, and not more than 2 per cent by volume of hydrocarbons, consists in that air at a temperature of 90–110°K is passed through adsorbents having the same temperature, the size of the inlet openings in the voids of the adsorbent being from 5 to 150 A. Xenon, krypton, nitrogen, oxygen, and hydrocarbons are adsorbed on this material and then said gases are desorbed from it by increasing stepwise the temperature from 90°–110°K to 250°–280°K in the course of from one to three hours and from 250–280°K to 500–650°K in the course of from 2 to 4 hours.

4 Claims, No Drawings

METHOD OF SEPARATING KRYPTON-XENON CONCENTRATE FROM AIR

The present invention relates to cryogenic technology, and more particularly in relates to a method of separating krypton-xenon concentrate from air.

The krypton-xenon concentrate is used for obtaining rare gases, viz., krypton and xenon, that are used for filling incandescent lamps, especially super-powerful and high-pressure lamps, and in medicine.

Known in the prior art are methods for separating krypton-xenon concentrate from air by a multi-stage processes combining rectification and chemical removal of hydrocarbons contained in air. For example, a method is known for obtaining krypton-xenon concentrate by additional rectification of oxygen obtained by air separation.

The total content of krypton and xenon in the so-called primary concentrate obtained by rectification does not exceed 0.1 – 1 per cent by volume since hydrocarbons (mainly methane) and inevitably accumulated in the concentrate too.

The obtained concentrate, actually oxygen containing admixtures of krypton, xenon, and hydrocarbons, is heated to a temperature of 700°C in the presence of a catalyst to burn out hydrocarbons. Said processing of large masses of a strongly oxidizing medium (99–99.9 per cent of $O_2$) results in strong corrosion of the catalyst, and is actually the main disadvantage of the method.

In this connection attempts were made to use adsorption in order to separate krypton-xenon concentrate from liquid air, liquid oxygen and oxygen fraction. These methods have one main disadvantage in common, namely, hydrocarbons are also adsorbed and the effectiveness of the process is low. Moreover, oxygen is adsorbed in this process too, and a dangerous explosive mixture is formed again.

Said disadvantages have been done with in a method in which after adsorption of krypton, xenon, oxygen and hydrocarbons from the primary concentrate on silica gel, oxygen in replaced with nitrogen.

However this method also deals with the primary concentrate obtained by the preliminary rectification, the concentrate containing from 0.1 to 0.2 per cent by volume of krypton and xenon. The process is complicate and fraught with danger of explosion.

Known in the prior art is also a method for separation from air of krypton-xenon concentrate containing krypton, xenon, oxygen and hydrocarbons, mainly methane.

According to this method, air cooled to a temperature of 90°K is passed at a pressure close to atmospheric through silica gel having inlet openings 25–150 A, and having the same temperature. During this process krypton, xenon, nitrogen, oxygen and hydrocarbons are adsorbed on silica gel. Said gases are then desorbed in two stages (See U.S. Pat. No. 2,698,523). At the first stage nitrogen heated to a temperature of 80°C is passed through a bed of silica gel and krypton and xenon are frozen out from the first eluate. Next krypton and xenon are selectively eluted with another nitrogen flow. The process is based on the different melting temperatures of krypton and xenon, which are 116.15°K and 161.25°K respectively.

This multi-step elution process takes place at low and high temperatures, with utilization of two flows of nitrogen, which inevitably involves loss of the valuable and rare gases.

The melting point of methane is 89°K and this gas will be the first to be frozen out and eluted to contaminate the krypton-xenon concentrate.

Moreover, during adsorption of krypton and xenon on silica gel at velocities of the gaseous flow of 1.5 m/min, some krypton remains unadsorbed and is entrapped in the effluent gas before the adsorbent is fully saturated. This envolves undue loss of krypton and lowers the coefficient of separation of the rare gas.

The object of this invention is to provide a method for separation from air of krypton-xenon concentrate ensuring higher coefficient of krypton and xenon separation.

Another object of the invention is to provide a method that would increase the concentration of krypton and xenon in the concentrate.

Still another object of the invention is to simplify the process.

In accordance with these and other objects, the invention consists in the proposed is a method of separation from air of krypton-xenon concentrate containing 1–46 per cent by volume of krypton, 0.1–4 percent by volume of xenon, 94.9–46 per cent by volume of nitrogen, maximum 2 per cent by volume of oxygen, and maximum 2 per cent by volume of hydrocarbons, by passing air at a temperature of 90°–110°K through adsorbent chilled to the same temperature and having voids with inlet openings 5–150 A, during which process krypton, xenon, nitrogen, oxygen and hydrocarbons are adsorbed on the adsorbent, with subsequent desorption of said gases, in which, according to the invention, gas desorption is effected by increasing stepwise the temperature of adsorption material from 90°–110°K to 250°K in the course of from 1 to 3 hours and then from 250°–280°K to 500°–650°K in the course of from 2 to 4 hours.

In order to increase the adsorbing power of the adsorption material and to make it possible to discard the spent air into atmosphere before desorption, it is recommended to carry out the adsorption process at a pressure of 4–7 kg/sq.cm. and to decrease the pressure to atmospheric before desorption.

In order to decrease krypton and xenon losses and to increase the separation coefficient, it is recommended that adsorption of krypton, xenon, nitrogen, oxygen, and hydrocarbons should be done on two beds of adsorbent, the first adsorbent (along the path-way of the process flow-sheet) being microporous silica gel having voids with inlet openings of 10–150 A, and the second adsorbent being synthetic zeolites having voids with inlet openings 5–9 A, the ratio of the bed heights being from 1:1 to 3:1 respectively.

Gradual, stepped increasing of the adsorbent temperature increases the concentration of krypton and xenon in the concentrate to 1–50 per cent by volume, the nitrogen content being from 94.9 to 46 per cent by volume and the content of admixtures of oxygen and hydrocarbons being insignificant and within safe limits.

Carrying out the adsorption process under pressure of 4–7 kg/sq.cm makes it possible to utilize more completely the adsorbing power of the material and to increase the concentration of krypton and xenon at the stage of description by preliminarily decreasing the pressure from 4–7 kg/sq.cm to atmospheric with simultaneous withdrawal of the air from the adsorber.

Increased pressure (4–7 kg/sq.cm) makes it possible to increase the temperature of the adsorbent to 100°–110°K which corresponds to the temperature of air saturation at said pressure.

In the process with two adsorbent beds, krypton, xenon and nitrogen, that displaces oxygen that has been preliminarily adsorbed on the adsorbent material, are adsorbed on the first (in the flow-sheet) adsorbent bed - microporous silica gel having inlet openings 10–150 A, while hydrocarbons and oxygen are not practically adsorbed on it.

The presence of the second (in the flow-sheet) adsorbent bed, which is synthetic zeolites having inlet openings 5–9 A increases the separation coefficient of krypton which is adsorbed in the upper part of this bed and the obtained krypton-xenon concentrate is completely freed from explosion-dangerous hydrocarbons (acetylene, methane, etc.).

The method of separation from air to krypton-xenon concentrate is realized preferably as follows.

Air compressed to 4–7 kgs/sq.cm is chilled to a temperature of 90°–110°K, for example, in regenerators of air-separation plant, and is delivered into one of the adsorbers filled with adsorbing material having inlet openings 5–150 A. The adsorption should preferably be carried out on two beds.

In the first (in the flow-sheet) adsorber, which is a microporous silica-gel having pores with openings sizing 10–150 A xenon, krypton, and nitrogen are predominantly adsorbed after cooling. In the process of adsorption, nitrogen displaces preliminarily adsorbed oxygen.

Then the air is passed through the second adsorbent bed, synthetic zeolites having pores from 5 to 9 A, (for example, synthetic zeolites NaX or CaA) where all hydrocarbon admixtures are separated.

After saturation of the adsorbers with krypton, xenon, and hydrocarbons, that is as soon as krypton appears in the gas passed through the first adsorbent (silica gel), the adsorber is switched off from the flow-sheet and the pressure is decreased to atmospheric. All air is removed from the adsorber. The temperature is then increased by steps from 90–110°K to 500°–650°K, first in the second adsorbent bed (zeolite), and then in the first adsorbent bed.

The adsorbent is heated by an electric heater or coils, that are located inside the adsorbent bed through which warm air is passed.

The temperature is first raised from 90°–110°K to 250°–280°K in the course of time from 1 to 3 hours. Krypton that is desorbed at the first moment from the zeolite is transferred into the first bed, and the, as a part of the krypton-xenon concentrate containing preferably 25 per cent of krypton and xenon, to 75 per cent of nitrogen and traces of oxygen and hydrocarbons, is collected as an intermediate product. As the temperature is raised to 250°–280°K, all krypton and xenon are practically desorbed.

The temperature is raised to 500°–650°K in the course of time from 2 to 4 hours and nitrogen, hydrocarbons, oxygen, and admixtures of krypton and xenon are desorbed into atmosphere.

The coefficient of separation of krypton and xenon by the proposed method is 0.85. Thus, practically all krypton and xenon are extracted from the air before it is delivered into the separation plant.

Further processing of the obtained krypton-xenon concentrate can be done by condensation, rectification, or adsorption. The process for obtaining krypton and xenon is simplified, and the process of further air separation and the process of further purification of krypton and xenon become quite safe.

For a better understanding of the invention, the following examples of its practical embodiment are given by way of illustration.

EXAMPLE 1

Air, at a pressure close to atmospheric, and chilled to a temperature of 90°K, is passed through a bed of silica gel having pores with inlet openings of 80 A. The silica gel is cooled by the air flow to 90°K. Xenon, krypton and nitrogen are adsorbed on the silica gel. Oxygen and hydrocarbons are adsorbed to an insignificant extent, and moreover, oxygen is displaced with nitrogen.

As soon as the adsorbent is saturated with the rare gases, and krypton appears at the exit from the absorber, the latter is switched off and said gases are desorbed by heating the silica gel.

The silica gel is heated in two steps: first the temperature is raised from 90° to 250°K in the course of one hour and the krypton-xenon concentrate, containing 46 per cent by volume of krypton, 0.1 per cent by volume of xenon, 95 per cent by volume of nitrogen, and traces of oxygen and hydrocarbons, is collected. The temperature of the silica gel is then raised from 250° to 500°K in the course of three hours and the desorbed gases are discarded into atmosphere.

The coefficient of krypton and xenon separation from air is 0.5.

EXAMPLE 2

Air, at a pressure close to atmospheric, and cooled to a temperature of 105°K, is passed through two beds of adsorbent having the same temperature. The ratio of the heights of the adsorbent beds is 1:1. The first adsorbent bed is silica gel having pores with inlet openings of 150 A, and the second adsorbent is synthetic zeolite CaA having pores with inlet openings of 5 A. Xenon, krypton, nitrogen, and insignificant quantity of oxygen and hydrocarbons are adsorbed on the first adsorbent, and krypton, nitrogen, oxygen and hydrocarbons are adsorbed on the second adsorbent bed.

As soon as the adsorbents have been saturated, the adsorbed gases are desorbed by increasing step-wise the temperature of the adsorbent from 105°K to 280°K in the course of time from of two hours and the krypton-xenon concentrate, containing 48 per cent by volume of krypton, 1.2 per cent by volume of xenon, 46.8 per cent by volume of nitrogen, 2 per cent by volume of oxygen and 2 per cent by volume of hydrocarbons, is collected.

The adsorbents are then heated to a temperature from 280° to 650°K in the course of 3 hours and desorbed nitrogen, hydrocarbons, and also insignificant quantity of oxygen, xenon and krypton are discarded into atmosphere.

The coefficient of xenon and krypton separation is 0.8.

EXAMPLE 3

Air cooled to a temperature of 110°K, under a pressure of 4 kg/sq.cm, is passed through a bed of silica gel having pores with inlet openings of 10 A and the temperature of 110°K.

Xenon, krypton, nitrogen, and insignificant quantity of oxygen, and hydrocarbons are adsorbed on said silica gel.

As soon as the adsorbent is saturated, that is as krypton appears at the exit from the adsorbent bed, the pressure discarded into atmosphere.

Then the adsorbed gases are desorbed by increasing the temperature of the from 110° to 280°K in the course of 2 hours, and the krypton-xenon concentrate, containing 36 per cent of by volume of krypton, 3 per cent by volume of xenon, 58 per cent by volume of nitrogen, 2 per cent by volume of oxygen, and traces of hydrocarbons, is collected.

The second stage desorption is similar to that described in Example 2.

The coefficient of cry krypton and xenon separation is 0.55.

EXAMPLE 4

Air, cooled to a temperature of 102°K, under a pressure of 7 kg/sq.cm is passed through two beds of adsorbents, having the same temperature. The first adsorbent bed is silica gel having pores with inlet openings of 31 A. It adsorbs predominantly xenon, krypton, nitrogen and insignificant quantity of hydrocarbons.

The second adsorbent is synthetic zeolite NaX, having pores with inlet openings of 9 A. It adsorbs krypton, oxygen, nitrogen and practically all hydrocarbons. The ratio of the heights of the adsorbent beds is 3:1. As soon as the first bed is saturated with krypton, that is as soon as krypton appears in the gas at the exit from the adsorbent bed, the pressure is decreased from 7 kg/sq.cm to atmospheric, and the air, and partly nitrogen, are discarded to atmosphere.

The adsorbed gases are then desorbed by increasing gradually the temperature of the adsorbent from 102° to 275°K in the course of three hours. The krypton-xenon concentrate, containing 46 per cent by volume of krypton, 4 per cent by volume of xenon, 49 per cent by volume of nitrogen, 1 per cent by volume of oxygen and hydrocarbons, is collected.

The temperature of the adsorbent is then increased from 275° to 570°K in the course of 4 hours and the desorbed gas, free of xenon and krypton, is discarded to atmosphere.

The coefficient of krypton and xenon separation is 0.85.

I claim:

1. A method for separation from air of krypton-xenon concentrate containing 1–46 per cent by volume of krypton, 0.1–4 per cent by volume of xenon, 94.9–46 per cent by volume of nitrogen, maximum 2 per cent by volume of oxygen and maximum 2 per cent by volume of hydrocarbons, consisting in that air at a temperature of 90°–110°K is passed through adsorbents having the same temperature and having pores with inlet openings of 5–150 A, on which xenon, krypton, nitrogen, oxygen and hydrocarbons are adsorbed; said gases are then desorbed from the adsorbent by increasing step-wise the temperature of the adsorbent from 90°–110°K to 250°–280°K in the course of time from 1 to 3 hours, and from to 250°–280°K to 500°–650°K in the course of time from 2 to 4 hours.

2. A method according to claim 1, in which the adsorption is carried out at a pressure of air of 4–7 kg/sq.cm, and before desorption the air pressure is reduced from 4–7 kg/sq.cm to atmospheric.

3. A method according to claim 1, in which the adsorption of xenon, krypton, nitrogen, oxygen and hydrocarbons is effected on two beds of the adsorbent, of which the first is microporous silica gel with pores having inlet openings from 10 to 150 A, and the second adsorbent is synthetic zeolites with pores having inlet openings from 5 to 9 A, the ratio of the heights of the adsorbent beds being from 1:1 to 3:1 respectively.

4. A method according to claim 2, in which xenon, krypton, nitrogen, oxygen, and hydrocarbons are adsorbed on two beds of adsorbents, of which the first adsorbent is microporous silica gel having pores with inlet openings from 10 to 150 A, and the second adsorbent is synthetic zeolites having pores with inlet openings from 5 to 9 A, the ratio of the heights of the adsorbent beds being from 1:1 to 3:1 respectively.

* * * * *